US008373621B2

(12) United States Patent
Jung et al.

(10) Patent No.: US 8,373,621 B2
(45) Date of Patent: Feb. 12, 2013

(54) ARRAY SUBSTRATE AND LIQUID CRYSTAL DISPLAY DEVICE HAVING THE SAME

(75) Inventors: Kwang-Chul Jung, Gyeonggi-do (KR); Mee-Hye Jung, Gyeonggi-do (KR); Chong-Chul Chai, Seoul (KR); Hee-Seop Kim, Gyeonggi-do (KR); Joo-Nyung Jang, Gyeongsangbuk-do (KR); Hwa-Sung Woo, Gyeonggi-do (KR); Cheol Shin, Gyeonggi-do (KR)

(73) Assignee: Samsung Display Co., Ltd. (KR)

( * ) Notice: Subject to any disclaimer, the term of this patent is extended or adjusted under 35 U.S.C. 154(b) by 600 days.

(21) Appl. No.: 12/628,979

(22) Filed: Dec. 1, 2009

(65) Prior Publication Data

US 2011/0128210 A1 Jun. 2, 2011

(51) Int. Cl.

| | |
|---|---|
| ***G09G 3/36*** | (2006.01) |
| ***G09G 3/00*** | (2006.01) |
| ***G09G 3/20*** | (2006.01) |

(52) U.S. Cl. ..... 345/32; 345/55; 345/92

(58) Field of Classification Search ..... None
See application file for complete search history.

(56) References Cited

U.S. PATENT DOCUMENTS

| | | | | |
|---|---|---|---|---|
| 7,705,819 | B2 * | 4/2010 | Choi et al. | 345/98 |
| 7,990,504 | B2 * | 8/2011 | Lee et al. | 349/141 |
| 8,179,489 | B2 * | 5/2012 | Jung et al. | 349/39 |

* cited by examiner

*Primary Examiner* — K. Wong
(74) *Attorney, Agent, or Firm* — Innovation Counsel LLP

(57) ABSTRACT

A liquid crystal display device includes a first thin film transistor connected to a first data line and controlling a first voltage output, a second thin film transistor connected to a second data line parallel to the first data line and controlling a second voltage output, a third thin film transistor connected to a third data line disposed between the first data line and the second data line and controlling a third voltage output, a first liquid crystal capacitor electrically connected to the first thin film transistor and the third thin film transistor, and a second liquid crystal capacitor electrically connected to the second thin film transistor and the third thin film transistor.

16 Claims, 7 Drawing Sheets

ARRAY SUBSTRATE AND LIQUID CRYSTAL DISPLAY DEVICE HAVING THE SAME

BACKGROUND OF THE INVENTION

1. Field of the Invention

The present invention relates to an array substrate and a liquid crystal display device having the same, more particularly, an array substrate of a liquid crystal display device having a wide viewing angle.

2. Description of the Related Art

A liquid crystal display ("LCD") device displays images by applying voltages to liquid crystal molecules disposed between two substrates on which polarizers are attached to control transmissivity of the liquid crystal molecules. LCD devices are widely preferred for their thinness, lightness, and low voltage consumption among various display devices. However, viewing angle of an LCD device is relatively narrow since inclined polarized incident light is not completely eliminated in an LCD. Attempts have been made to widen the viewing angle of a LCD, such as multi-domain driving, phase difference compensation, in-plane switching mode, and vertical alignment mode.

BRIEF SUMMARY OF THE INVENTION

Exemplary embodiments of the present invention provide an array substrate and liquid crystal display device having the same, which improves transmissivity and image sticking.

According to an exemplary embodiment of the present invention, an array substrate includes a first switching component, a second switching component, a third switching component, a first electrode, a second electrode, a third electrode, and a fourth electrode. The first switching component is connected to a first data line. The second switching component is connected to a second data line parallel to the first data line. The third switching component is connected to the third data line disposed between the first data line and the second data line. The first electrode is connected to the first switching component and has a plurality of protrusions extending toward the third data line. The second electrode is connected to the third switching component and has a plurality of protrusions. The protrusions of the first electrode and second electrode are alternately disposed. The third electrode is connected to the third switching component and has a plurality of protrusions extending toward the second data line. The fourth electrode is connected to the second switching component and has a plurality of protrusions. The plurality of protrusions of the third and fourth electrodes are alternately disposed.

According to another exemplary embodiment of the present invention, a liquid crystal display device includes a first thin film transistor, a second thin film transistor, a third thin film transistor, a first liquid crystal capacitor, and a second liquid crystal capacitor. The first thin film transistor is connected to a first data line and controls a first voltage output. The second thin film transistor is connected to a second data line parallel to the first data line and controls a second voltage output. The third thin film transistor is connected to a third data line disposed between the first and second data lines and controls a third voltage output. The first liquid crystal capacitor is electrically connected to the first and third thin film transistors. The second liquid crystal capacitor is electrically to the second and third thin film transistors.

BRIEF DESCRIPTION OF THE DRAWINGS

Exemplary embodiments of the present invention can be understood more in detail from the following description taken in conjunction with the accompanying drawings, in which.

DESCRIPTION OF EXEMPLARY EMBODIMENTS

Exemplary embodiments of the present invention are described more fully hereinafter with reference to the accompanying drawings, in which exemplary embodiments of the invention are shown. This invention may, however, be embodied in many different forms and should not be construed as limited to the embodiments set forth herein. Use of the same reference symbols in different figures indicates similar or identical items, and duplicated explanation of the same reference symbols is omitted.

Figure 1:
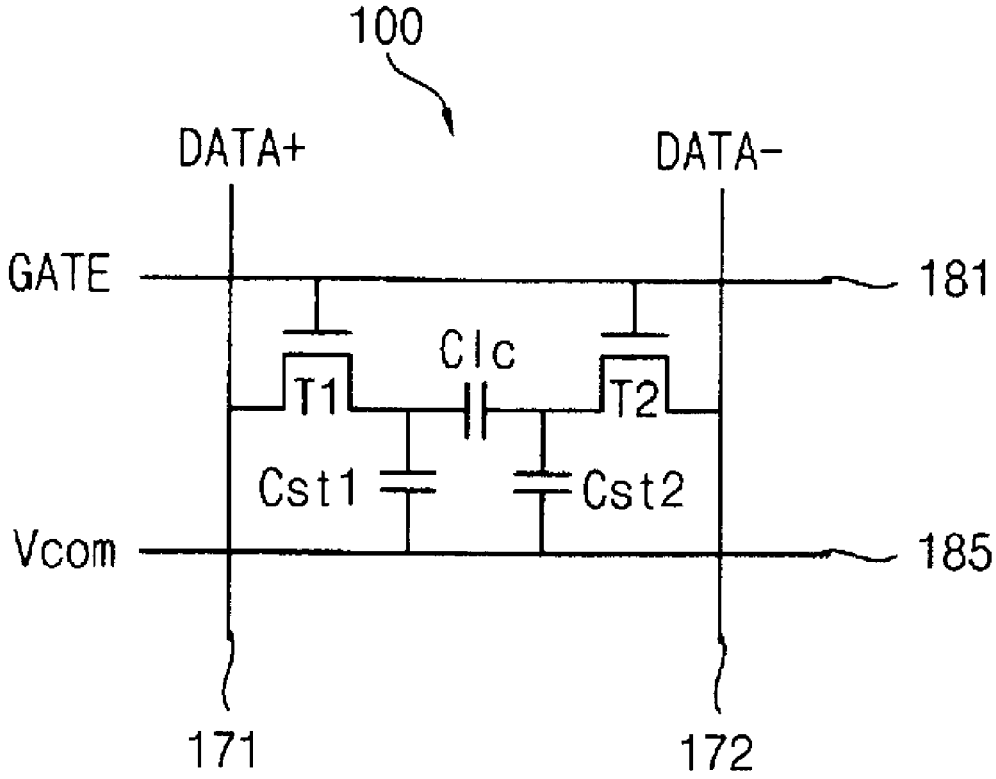
FIG. 1 is an equivalent circuit diagram of a liquid crystal display panel according to an exemplary embodiment of the present invention.

FIG. 1 is an equivalent circuit diagram of a liquid crystal display panel according to an exemplary embodiment of the present invention.

Referring to FIG. 1, the liquid crystal display device panel includes a pixel 100 having a first data line 171, a second data line 172, a gate line 181, and a storage capacitor line 185.

The first data line 171 is parallel to the second data line 172. The first data line 171 and the second data line 171 transfer a first voltage DATA+ and a second voltage DATA− respectively. The first voltage DATA+ and the second voltage DATA− may be determined according to an image data.

The gate line 181 intersects with the first data line 171 and the second data line 172 and transfers a gate voltage GATE.

The storage capacitor line 185 is parallel to the gate line 181 and transfers a common voltage Vcom.

The pixel 100 is defined by the first and second data lines 171 and 172, the gate line 181 and the storage capacitor line 185. The pixel 100 includes a first switching component T1, a second switching component T2, a liquid crystal capacitor Clc, a first storage capacitor Cst1, and a second storage capacitor Cst2. The switching components may be thin film transistors.

The first switching component T1 includes a gate electrode electrically connected to the gate line 181, a source electrode electrically connected to the first data line 171, and a drain electrode electrically connected to an end of the liquid crystal capacitor Clc. The second switching component T2 includes a gate electrode electrically connected to the gate line 181, a source electrode electrically connected to the second data line 172, and a drain electrode electrically connected to another end of the liquid crystal capacitor Clc.

The first storage capacitor Cst1 is electrically connected to the drain electrode of the first switching component T1 and the storage capacitor line 185. The second storage capacitor Cst2 is electrically connected to the drain electrode of the second switching component T2 and the storage capacitor line 185. The first and second storage capacitors Cst1 and Cst2 act as a buffer to reduce the effects of the voltage dependence and leakage of a liquid crystal capacitance to obtain uniform gray level performance across the display panel.

The liquid crystal capacitor Clc includes a first electrode electrically connected to the drain electrode of the first switching component T1, a second electrode electrically connected to the drain electrode of the second switching component T2, and liquid crystal layer having liquid crystal molecules disposed between the first and second electrodes. An electric field generated between the first and second electrodes of the liquid crystal capacitor Clc changes the orientation of the liquid crystal molecules to control the transmissivity of the liquid crystal layer.

Figure 2:
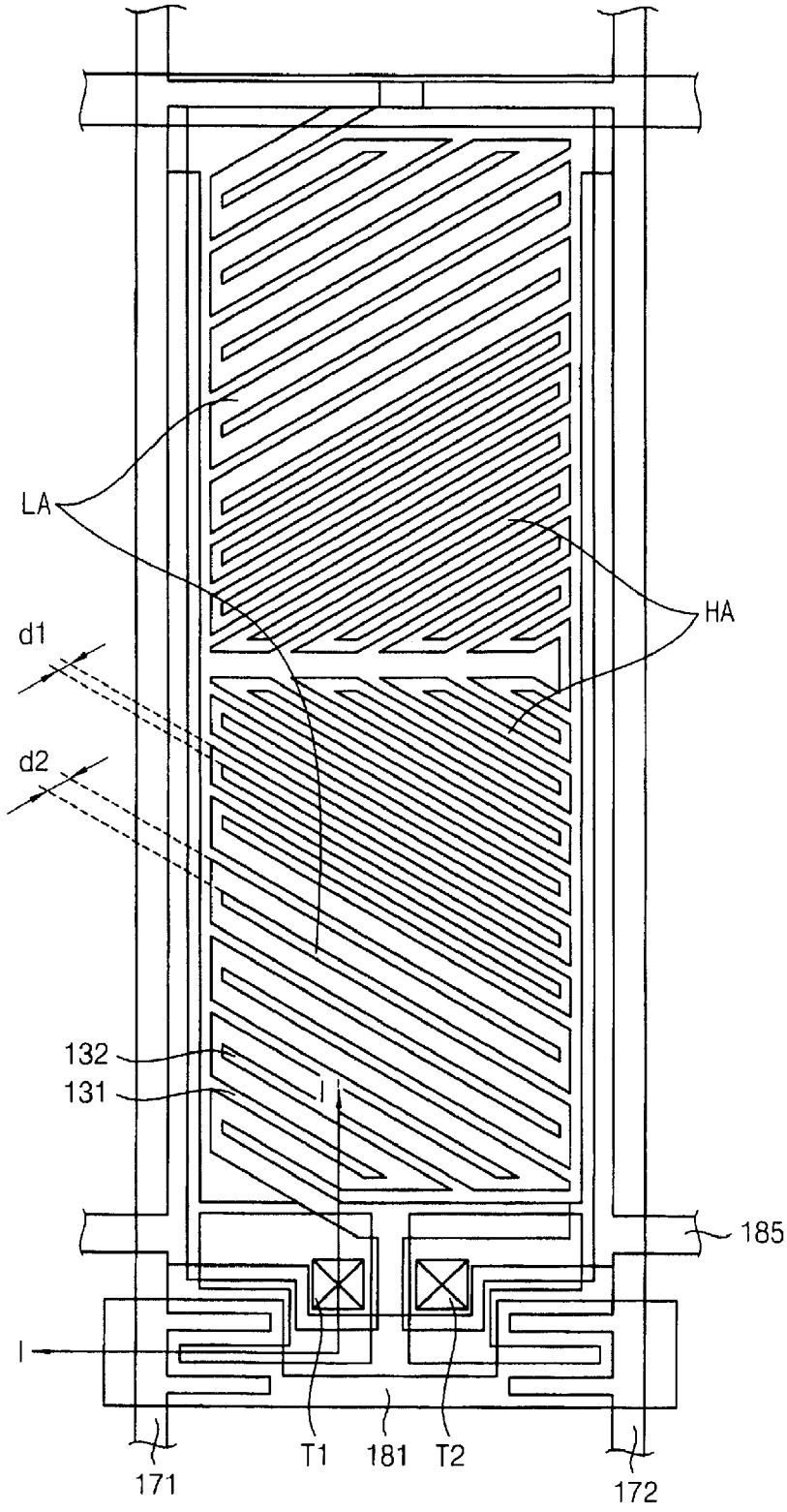
FIG. 2 is a plan view of a pixel of an array substrate of the liquid crystal display panel of FIG. 1.
Figure 3:
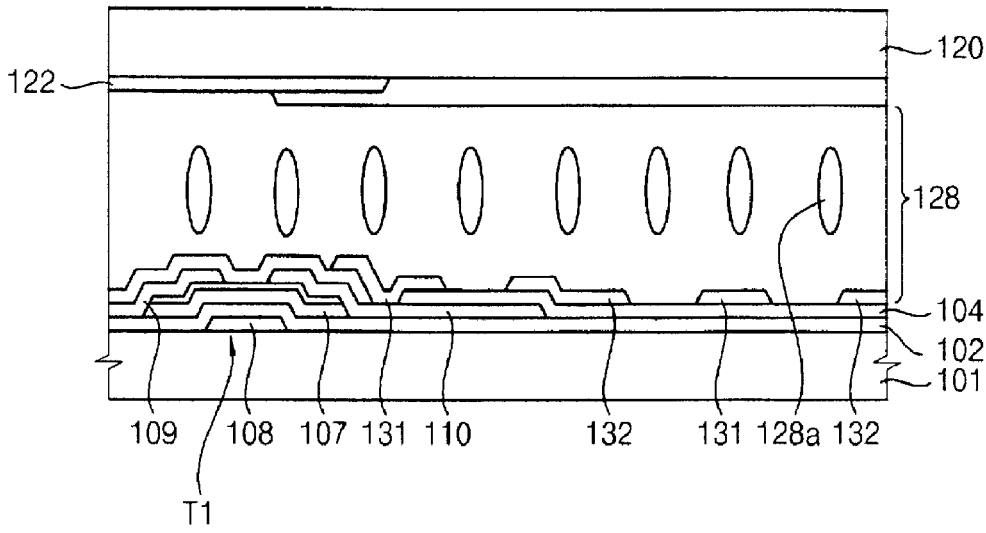
FIG. 3 is a cross-sectional view of FIG. 2 along line I-I'.

FIGS. 2 and 3 are plan views of a pixel of an array substrate of the liquid crystal display panel of FIG. 1 and a cross sectional view of FIG. 2 along line I-I', respectively.

Referring to FIGS. 2 and 3, the gate electrodes of the first and second switching components T1 and T2, the gate line 181, and the storage capacitor line 185 are formed on a first base substrate 101.

The gate electrode 108 of the first switching component T1, the gate line 181, and the storage capacitor line 185 are covered with a gate insulating layer 102 formed on the first base substrate 101. The second switching component T2 may have the same structure as the first switching component T1.

A semiconductor layer 107 is formed on the gate insulating layer 102 corresponding to the gate electrode 108. The semiconductor layer 107 may include an amorphous silicon layer and an n+ amorphous silicon layer.

The source electrode 109 and the drain electrode 110 of the first switching component T1 are separately formed on the semiconductor layer 107.

The first data line 171 is formed on the gate insulating layer 102 and electrically connected to the source electrode 109 of the first switching component T1. The second data line 172 is formed on the gate insulating layer 102 and electrically connected to the source electrode of the second switching component T2.

A passivation layer 104 is formed on the gate insulating layer 102 and covers the gate electrodes 108 of the first and second switching components T1 and T2 and the storage capacitor line 185.

The drain electrode 110 of the first switching component T1 is electrically connected to the first electrode 131 of the liquid crystal capacitor Clc via a contact hole formed on the passivation layer 104. In this embodiment, the first electrode 131 has a plurality of protrusions. The protrusions forms a comb-like structure wherein the protrusions correspond to the teeth of a comb.

The drain electrode 104 of the second switching component T2 is electrically connected to the second electrode 132 of the liquid crystal capacitor Clc via a contact hole formed on the passivation layer 104. In this embodiment, the second electrode 132 has comb-like structures which are alternately arranged with the comb-like structures of the first electrode 131. The first electrode 131 and the second electrode 132 may be made from the same layer. In this embodiment, the comb-like structures of the first and second electrodes 131 and 132 may extend an angle with respect to the gate line 181. For instance, the comb-like structures of the first and second electrodes 131 and 132 may be formed at a 45-degree angle to the gate line 181.

In this embodiment, the pixel 100 is divided to a high gray area HA which has a slit width d1 and a low gray area LA which has a slit width d2. The width d1 between the first electrode 131 and the second electrode 132 in the high gray area HA is narrower than the width d2 between the first electrode 131 and the second electrode 132 in the low gray area LA.

A black matrix 122 is formed on a second base substrate 120. The black matrix 122 blocks light passing through an area where the liquid crystal molecules 128*a* is not controlled to create a higher contrast ratio of the liquid crystal display device. The liquid crystal layer 128 is disposed between the first base substrate 101 and the second base substrate 120.

Figure 4:
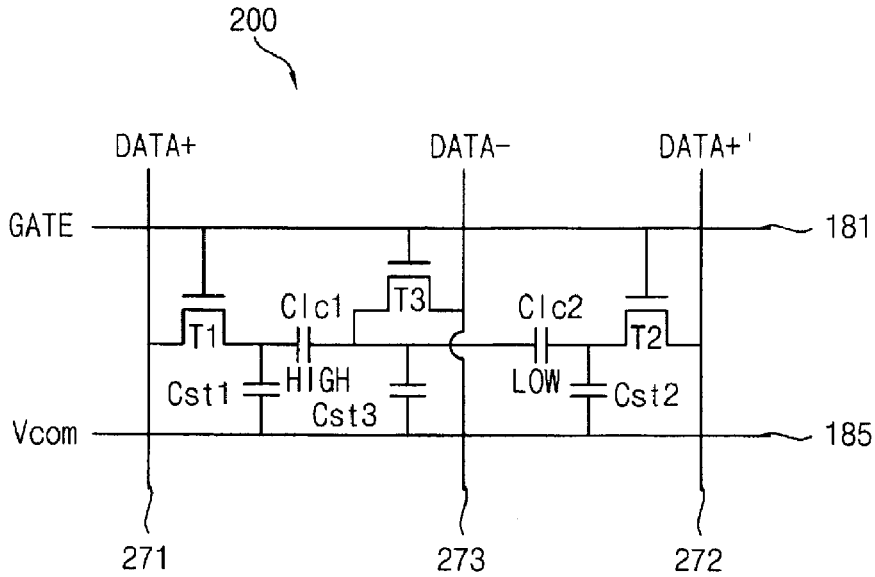
FIG. 4 is an equivalent circuit diagram of liquid crystal display panel according to another exemplary embodiment of the present invention.

FIG. 4 is an equivalent circuit diagram of liquid crystal display panel according to another exemplary embodiment of the present invention.

Referring to FIG. 4, the liquid crystal display panel includes a pixel 200 having a first data line 271, a second data line 272, a third data line 273, a gate line 181, and a storage capacitor line 185.

The first data line 271, the second data line 272, and the third data line 273 are parallel to each other. The first data line 271, the second data line 271, and the third data line 273 transfer a first voltage DATA+, a second voltage DATA+' and a third voltage DATA− respectively. The first voltage DATA+, the second voltage DATA+', and the third voltage DATA−, may be determined according to an image data. In this embodiment, the second voltage DATA+' may be lower than the first voltage DATA+. For instance, the first voltage DATA+ may be +12V, the second voltage DATA+' may be +6V, and the third voltage DATA− may be −6V.

The gate line 181 intersects the first, second, and third data lines 271, 272, and 273 and transfers a gate voltage GATE.

The storage capacitor line 185 is parallel to the gate line 181 and transfers a common voltage Vcom.

The pixel 200 is defined by the first and second data lines 271 and 272, the gate line 181, and the storage capacitor line 185 and is electrically connected to display images. The pixel 200 includes a first switching component T1, a second switching component T2, a third switching component T3, a first liquid crystal capacitor Clc1, a second liquid crystal capacitor Clc2, a first storage capacitor Cst1, a second storage capacitor Cst2, and a third storage capacitor Cst3.

The first switch component T1 includes a gate electrode electrically connected to the gate line 181, a source electrode electrically connected to the first data line 271, and a drain electrode electrically connected to a first end of the first liquid crystal capacitor Clc1. The second switching component T2 includes a gate electrode electrically connected to the gate line 181, a source electrode electrically connected to the second data line 272, and a drain electrode electrically connected to a first end of the second liquid crystal capacitor Clc2. The third switching component T3 includes a gate electrode electrically connected to the gate line 181, a source electrode electrically connected to the third data line 273, and a drain electrode electrically connected to a second end of the first liquid crystal capacitor Clc1 which is electrically connected to a second end of the second liquid crystal capacitor Clc2.

The first storage capacitor Cst1 is electrically connected to the drain electrode of the first switching component T1 and the storage capacitor line 185. The second storage capacitor Cst2 is electrically connected to the drain electrode of the second switching component T2 and the storage capacitor line 185. The third storage capacitor Cst3 is electrically connected to the drain electrode of the third switching component T3 and the storage capacitor line 185. The first, second, and third storage capacitors Cst1, Cst2, and Cst3 act as a buffer to reduce the effects of the voltage dependence and leakage of a liquid crystal capacitance to obtain uniform gray level performance across the display panel.

The first liquid crystal capacitor Clc1 includes a first electrode electrically connected to the drain electrode of the first switching component T1, a second electrode electrically connected to the drain electrode of the second switching component T2, and a liquid crystal layer 128 having liquid crystal molecules 128*a* (see FIG. 3) disposed between the first and second electrodes. The second liquid crystal capacitor Clc2 includes a third electrode electrically connected to the drain electrode of the third switching component T3, a fourth electrode electrically connected to the drain electrode of the second switching component T2, and liquid crystal layer 128 having liquid crystal molecules 128*a* disposed between the third and fourth electrodes.

Electric fields generated between the first and second electrodes of the first liquid crystal capacitor Clc1 and the third and fourth electrodes of the second liquid crystal capacitor Clc2 changes the orientation of the liquid crystal molecules to control the transmissivity of the liquid crystal layer.

Figure 5:
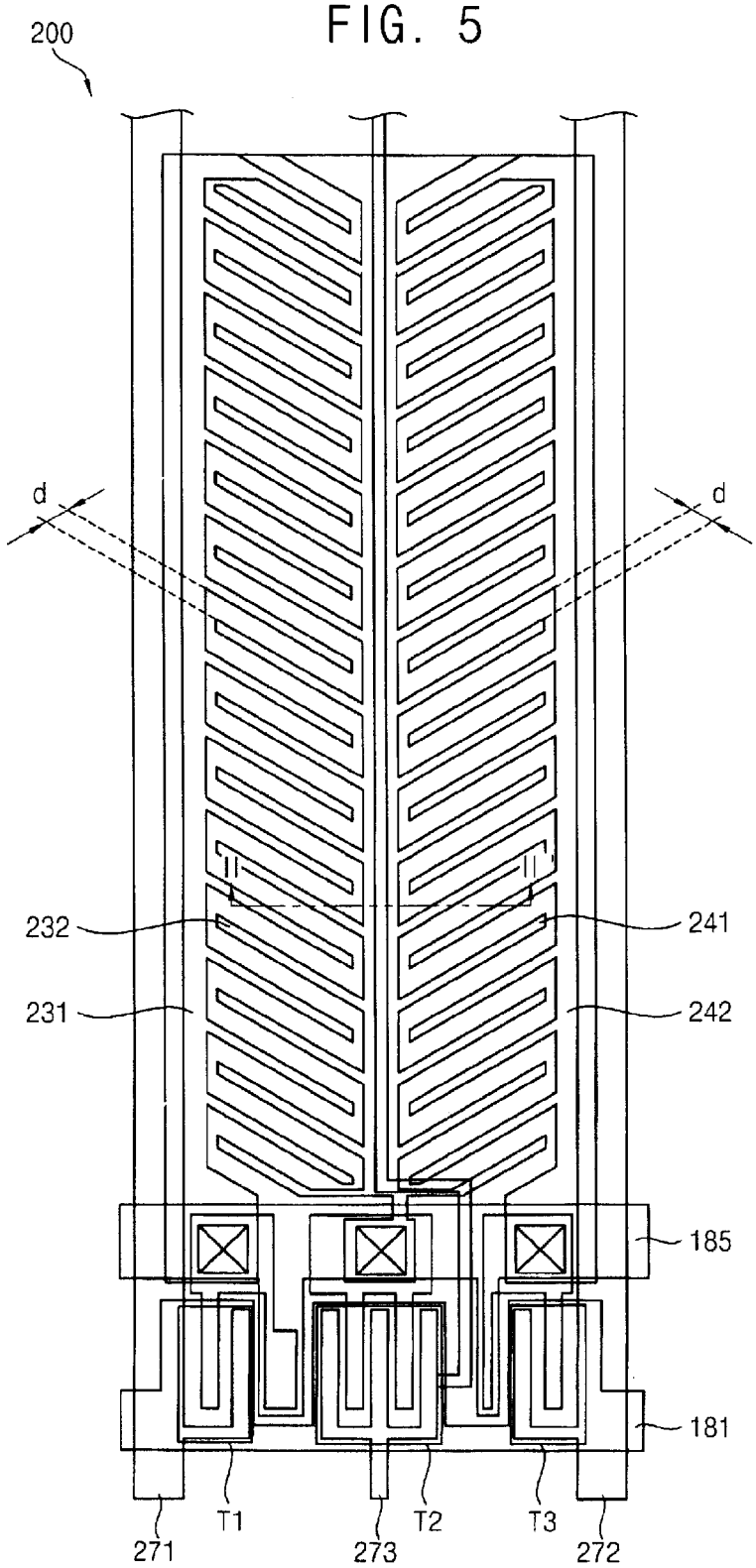
FIG. 5 is a plan view of a pixel of an array substrate of the liquid crystal display panel of FIG. 4.
Figure 6:
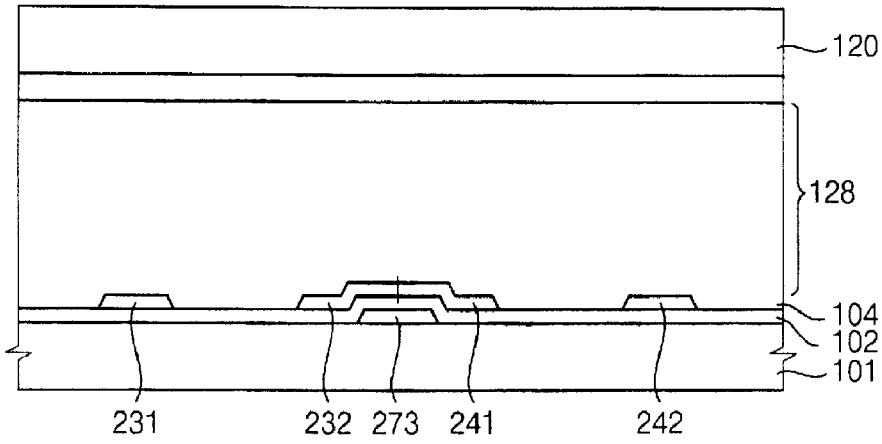
FIG. 6 is a cross-sectional view of FIG. 5 along line II-IF.

FIG. 5 is a plan view of a pixel of an array substrate of the liquid crystal display panel of FIG. 4. FIG. 6 is a cross-sectional view of FIG. 2 along line II-II'. In this embodiment, duplicated explanation of the same elements as described in FIGS. 1 to 3 is omitted.

Referring to FIGS. 5 and 6, the gate electrodes of the first, second, and third switching components T1, T2, and T3, the gate line 181, and the storage capacitor line 185 are formed on a first base substrate 101.

The gate electrodes of the first, second, and third switching components T1, T2, and T3, the gate line 181, and the storage capacitor line 185 are covered with a gate insulating layer 102 formed on the first base substrate 101.

A semiconductor layer is formed on the gate insulating layer 102 corresponding to the gate electrodes of the first, second, and third switching components T1, T2, and T3. The source electrodes and the drain electrodes of the first, second, and third switching components T1, T2, and T3 are separately formed on the semiconductor layer.

The first, second, and third data lines 271, 272, and 273 are formed on the gate insulating layer 102 and electrically connected to the source electrodes of the first, second, and third switching components T1, T2, and T3 respectively.

A passivation layer 104 is formed on the gate insulating layer 102 and covers the gate electrodes of the first, second, and third switching components T1, T2, and T3 and the storage capacitor line 185.

The drain electrode of the first switching component T1 is electrically connected to the first electrode 231 of the first liquid crystal capacitor Clc1 via a contact hole formed on the passivation layer 104. In this embodiment, the first electrode 231 has a comb-like structure. The drain electrode of the third switching component T3 is electrically connected to the second electrode 232 of the first liquid crystal capacitor Clc1 and the third electrode 241 of the second liquid crystal capacitor Clc2 via a contact hole formed on the passivation layer 104. In this embodiment, the second electrode 232 of the first liquid crystal capacitor Clc1 has a comb-like structure having protrusions which are alternately arranged with protrusions of the comb-like structure of the first electrode 231. The third electrode 241 of the second liquid crystal capacitor Cslc2 also have a comb-like structure.

In this embodiment, the comb-like structures of the first, second, third, and fourth electrodes 231, 232, 233, and 234 may be at an angle to the first, second, and/or third data lines 271, 272, and/or 273.

The drain electrode of the second switching component T2 is electrically connected to the fourth electrode 242 of the second liquid crystal capacitor Clc2 via a contact hole formed on the passivation layer 104. In this embodiment, the fourth electrode 242 of the second liquid crystal capacitor Clc2 has a comb-like structure with protrusions which are alternately arranged with the protrusions of third electrode 241 of the second liquid crystal capacitor Clc2. The first, second, third, and fourth electrodes 231, 232, 241 and, 242 may be made from the same layer.

In this embodiment, width d of the slits between protrusions of the first electrode 231 and the second electrode 232 of the first liquid crystal capacitor Clc1 are uniform throughout the pixel 200. The width d' of the slits between the protrusions of the third electrode 241 and the fourth electrode 242 are also uniform throughout the pixel 200. In this embodiment, wide viewing angle may be implemented by controlling voltage levels applied to the first, second, and third data lines 271, 272, and 273.

Figure 7:
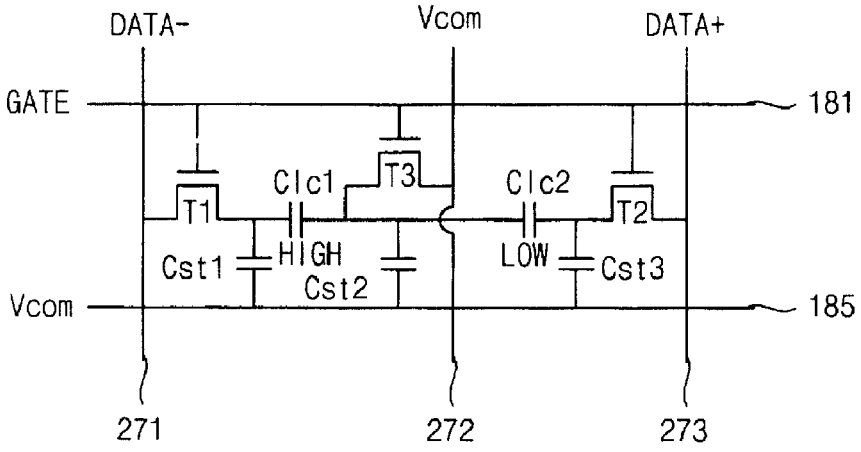
FIG. 7 is an equivalent circuit diagram of liquid crystal display panel according to still another exemplary embodiment of the present invention.

FIG. 7 is an equivalent circuit diagram of liquid crystal display panel according to still another exemplary embodiment of the present invention. In this embodiment, duplicated explanation of the same elements as described in FIG. 4 is omitted.

Referring to FIG. 7, the liquid crystal display panel includes a pixel 300 having a first data line 271, a second data line 272, a third data line 273, a gate line 181, and a storage capacitor line 185.

The first, second, and third data lines 271, 272, and 273 transfer a first voltage DATA−, a second voltage DATA+, and a third voltage Vcom, respectively. The first voltage DATA− and the second data voltage DATA+ may be determined according to an image data. In this embodiment, the second voltage DATA+ may have a higher level than the first voltage DATA−. For instance, the first voltage DATA− may be −6V, the second voltage DATA+ may be +12V, and the third voltage Vcom may be 0V.

The storage capacitor line 185 transfers a common voltage having equal level to the third voltage Vcom. According to this embodiment, the circuit structure can be simplified by applying an equal level of voltage.

Figure 8:
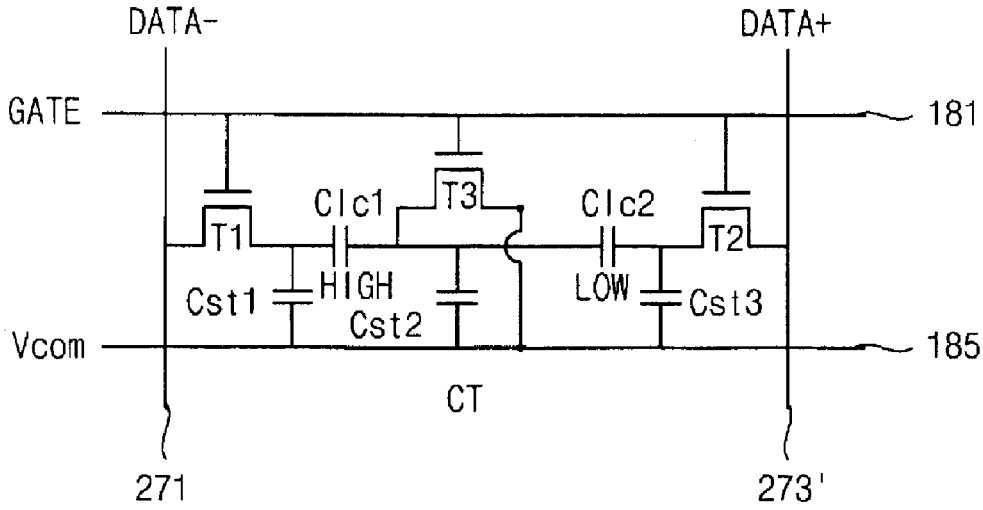
FIG. 8 is an equivalent circuit diagram of liquid crystal display panel according to still another exemplary embodiment of the present invention.
Figure 9:
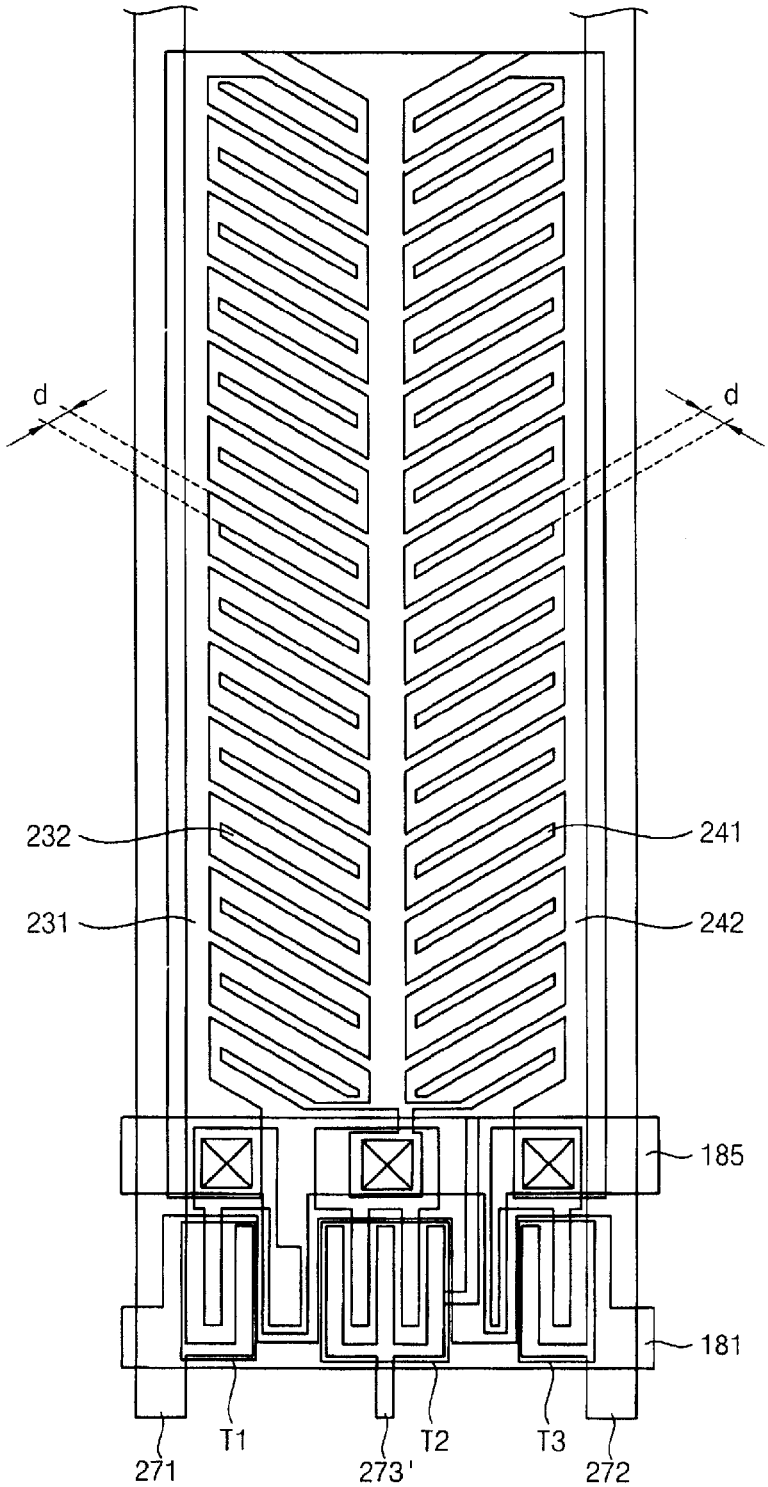
FIG. 9 is a plan view of a pixel of an array substrate of the liquid crystal display panel of FIG. 8.

FIGS. 8 and 9 are an equivalent circuit diagram of liquid crystal display panel according to still another exemplary embodiment of the present invention and a plan view of a pixel of an array substrate of the liquid crystal display panel of FIG. 8, respectively. In this embodiment, duplicate explanation as described above is omitted.

Referring to FIGS. 8 and 9, the third data line 273' is electrically connected to the storage capacitor line 185 via contact hole CT and does not overlap the first liquid crystal capacitor Clc1 and the second liquid crystal capacitor Clc2. Higher aperture ratio can be accomplished by non-overlapping structure of the third data line 273' and the first/second liquid crystal capacitors Clc1 and Clc2.

What is claimed is:

1. An array substrate comprising:

a first switching component connected to a first data line;

a second switching component connected to a second data line parallel to the first data line;

a third switching component connected to a third data line disposed between and parallel to the first and second data lines;

a first electrode connected to the first switching component and having a plurality of protrusions extending toward the third data line;

a second electrode connected to the third switching component and having a plurality of protrusions which are alternately disposed with the protrusions of the first electrode;

a third electrode connected to the third switching component and having a plurality of protrusions extending toward to the second data line; and a fourth electrode connected to the second switching component and having a plurality of protrusions which are alternately disposed with the comb-like structure of the third electrode.

2. The array substrate of claim 1, wherein a width of a gap between the protrusions of the first and second electrodes are substantially equal to a width of a gap between the protrusions of third and fourth electrodes.

3. The array substrate of claim 1, wherein at least one of the protrusions of the first, second, third and fourth electrodes extends at an angle relative to the first data line.

4. The array substrate of claim 1, further comprising gate lines, each gate lines being electrically connected to gate electrodes of the first, second, and third switching components respectively, and a storage capacitor lines parallel to the gate lines.

5. The array substrate of claim 4, wherein the third data line is electrically insulated from the storage capacitor lines.

6. The array substrate of claim 4, wherein the third data line is electrically connected to the storage capacitor line.

7. The array substrate of claim 6, wherein the third data line does not overlap the first, second, third and fourth electrodes.

8. A liquid crystal display device comprising:

a first thin film transistor connected to a first data line and controlling a first voltage output;

a second thin film transistor connected to a second data line parallel to the first data line and controlling a second voltage output;

a third thin film transistor connected to a third data line disposed between and parallel to the first data line and the second data line and controlling a third voltage output;

a first liquid crystal capacitor electrically connected to the first thin film transistor and the third thin film transistor; and a second liquid crystal capacitor electrically connected to the second thin film transistor and the third thin film transistor.

9. The liquid crystal display device of claim 8, wherein the first, second and third data lines transfer a first, second, and third voltages respectively, the first, second and third voltages being different from each other.

10. The liquid crystal display device of claim 9, wherein the level of the second voltage is lower than the level of the first voltage, and the polarity of the third voltage is different from the polarities of the first and second voltages.

11. The liquid crystal display device of claim 10, wherein the first, second and, third voltages are determined according to an image data.

12. The liquid crystal display device of claim 9, wherein the third voltage is a common voltage.

13. The liquid crystal display device of claim 12, wherein the first and second voltages are determined according to an image data.

14. The liquid crystal display device of claim 12, wherein the third data line does not overlap the first liquid crystal capacitor and the second liquid crystal capacitor.

15. The liquid crystal display device of claim 8, wherein the first liquid crystal capacitor has first and second electrodes having a plurality of protrusions, and the plurality of protrusions of the first and second electrodes are alternately disposed, and wherein the second liquid crystal capacitor has third and fourth electrodes having a plurality of protrusions, the plurality of protrusions of the third and fourth electrodes are alternately disposed.

16. The liquid crystal display device of claim 8, further comprising color filters disposed opposite the first and second liquid crystal capacitors.

* * * * *